United States Patent [19]

Marino

[11] Patent Number: 4,590,637

[45] Date of Patent: May 27, 1986

[54] GENERAL PURPOSE PAINT BRUSH

[75] Inventor: Frank Marino, Baldwin, N.Y.

[73] Assignee: The Wooster Brush Company, Wooster, Ohio

[21] Appl. No.: 636,978

[22] Filed: Aug. 2, 1984

[51] Int. Cl.[4] ..... A46B 9/02

[52] U.S. Cl. ..... 15/160; 15/159 A; 15/192

[58] Field of Search ..... 15/160, 166, 159 R, 15/159 A, 191 R, 192, 193, 194, 204; D4/130–135, 118

[56] References Cited

U.S. PATENT DOCUMENTS

| | | | |
|---|---|---|---|
| D. 117,933 | 12/1939 | Manchester et al. | D4/118 |
| 1,284,992 | 11/1918 | Belknap | 15/160 |
| 2,190,181 | 2/1940 | Beames | 15/204 |
| 2,584,504 | 2/1952 | Seeber | 15/166 |
| 2,674,759 | 4/1954 | Solberg | 15/193 |

FOREIGN PATENT DOCUMENTS

| | | | |
|---|---|---|---|
| 1069917 | 2/1954 | France | 15/159 R |
| 276523 | 9/1927 | United Kingdom . | |
| 297269 | 9/1928 | United Kingdom . | |

*Primary Examiner*—Peter Feldman

*Attorney, Agent, or Firm*—Renner, Otto, Boisselle & Lyon

[57] ABSTRACT

A general purpose paint brush comprises an elongate handle, a generally tubular, longitudinally extending ferrule secured to said handle, and a tuft of longitudinally extending bristles having a working end and a root end anchored in said ferrule. The tuft has substantially parallel side faces extending transversely the width of the tuft and defining therebetween a lesser thickness of the tuft, and the working end of the tuft has a planar working surface sharply angled in relation to a plane normal to the lengths of the bristles from one side face of the tuft to the other side face across the full thickness of the tuft to provide greater exposure of bristles at the working surface which enables the brush to hold and apply more paint. Also, the working surface forms with the longer side face of the tuft a sharp knife edge at such side face of the brush which renders the brush particularly suitable for use as a trim brush while the full thickness inclined working surface provides a large paint transfer surface.

9 Claims, 6 Drawing Figures

GENERAL PURPOSE PAINT BRUSH

DISCLOSURE

The invention herein disclosed relates generally to a general purpose paint brush for applying paint or other fluid-like material to walls, ceilings, baseboards, doors, moldings, etc. More particularly, the invention relates to an improved paint brush of general purpose type that will hold and apply considerably more paint than a conventional paint brush of the same size and type, and which is particularly suitable for trim work.

BACKGROUND

General purpose paint brushes are used to apply various types of paints or other fluid-like materials to various types of surfaces such as walls, ceilings, baseboards, moldings, etc. Typically, such brushes are of greater width than thickness to permit paint application usually in a wide stripe but also in a narrow stripe as needed. Although edging and line detail is of concern in some applications such as trim work, another important concern is rapid coverage of the surface to be painted with fewer paint strokes and reloadings of the brush by dipping. In contrast, specialty brushes such as artist brushes, hobby brushes, lining fitches, etc., are used to apply relatively small quantities of paint with particular emphasis being placed on detail. Such specialty brushes generally are unsuitable and not intended for general purpose use in painting relatively large surfaces that may need painting such as surfaces of homes, buildings or the like.

Conventional paint brushes of general purpose type characteristically include a bundle or tuft of bristles having a working end for applying the paint or other fluid-like material to a surface and a butt or root end anchored in a generally tubular ferrule or the equivalent, for example, by an epoxy or equivalent hardenable adhesive material. The bristles usually extend longitudinally in relation to the ferrule as does an elongate handle secured to the ferrule for manipulating the brush. As used herein, the term bristles includes hog bristle, synthetic filament, animal hair or other suitable materials which may comprise the tuft. Typically, the transverse cross-section of the tuft has a wide dimension or width which is considerably greater than its narrow dimension or thickness such as by a factor of 3 or 4. Accordingly, a relatively wide stripe of paint may be applied by stroking the brush in a direction generally normal to its width and a relatively narrow stripe of paint may be applied as needed by end-wise stroking of the brush, i.e., stroking in a direction generally parallel to the width dimension of the brush.

Paint brushes of the foregoing general type have had the working ends of their tufts formed to provide a generally planar working surface extending normal to the longitudinal extent of the bristles as seen, for example, in U.S. Pat. No. 2,190,181. The working ends of the tufts also have been somewhat convex in shape or consisted of oppositely tapered side surface portions which extend the width of the tuft with the longest bristles being located centrally of the thickness of the tuft as seen, for example, in U.S. Pat. No. 2,584,504. Also, the working surface or tip of the brush may extend normal to the length of the bristles or at an angle going from one narrow end of the tuft to the other narrow end across the full width of the tuft to provide what is sometimes referred to as an angle brush usually intended for trim work. Trim brushes such as angle brushes typically are used to trim around windows without getting paint on the glass or other surface not to be painted, to paint a trim line where walls and ceilings meet or where walls meet baseboards, doors, moldings, etc., and to paint a trim line when two different colors are to meet.

Although various forms of general purpose paint brushes have been provided to facilitate various painting tasks with acceptable results, it is a continuing desire to reduce the number of brush strokes and stops for redipping by having a brush which will pick up and smoothly apply considerably more paint than presently available brushes of corresponding size, i.e., those having tufts of like width, thickness and length, particularly during the first stroke of the brush after reloading. It also would be desirable to provide such a brush with a sharp edge that facilitates trim work.

SUMMARY OF THE INVENTION

The invention herein disclosed provides an improved general purpose paint brush having greater exposure of the bristles at the working surface of the brush as compared to conventional brushes of corresponding size and type for holding and applying more paint to a surface for example for making a longer stripe upon a single stroke of the brush. The brush also has a sharp edge for easier and sharper trimming and which is located such that during painting the painter can easily see the edge being painted.

Briefly, a general purpose paint brush according to the invention comprises an elongate handle, a generally tubular, longitudinally extending ferrule secured to said handle, and a tuft of longitudinally extending bristles having a working end and a root end anchored in such ferrule. The tuft has substantially parallel sides extending transversely the width of the tuft and defining therebetween a lesser thickness of the tuft, and the working end of the tuft has a planar working surface sharply angled from one side of the tuft to the other side across the full thickness of the tuft to provide, as above indicated, greater exposure of bristles at the working surface which enables the brush to hold and apply more paint. Also, the working surface forms with the longer side of the tuft a sharp knife edge at such side of the brush which, as above indicated, renders the brush particularly suitable for use as a trim brush while the full thickness inclined working surface provides a large paint transfer surface.

Further in accordance with the invention, the knife edge of the brush may extend normal to the lengths of the bristles with the tuft end of the ferrule terminating at a transverse plane normal to the lengths of the bristles. The working surface of the brush additionally may be angled from one narrow end face of the tuft to the other narrow end face across the full width of the tuft to provide an angled knife edge, in which case the tuft end of the ferrule preferably terminates at a plane parallel to the angled knife edge.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
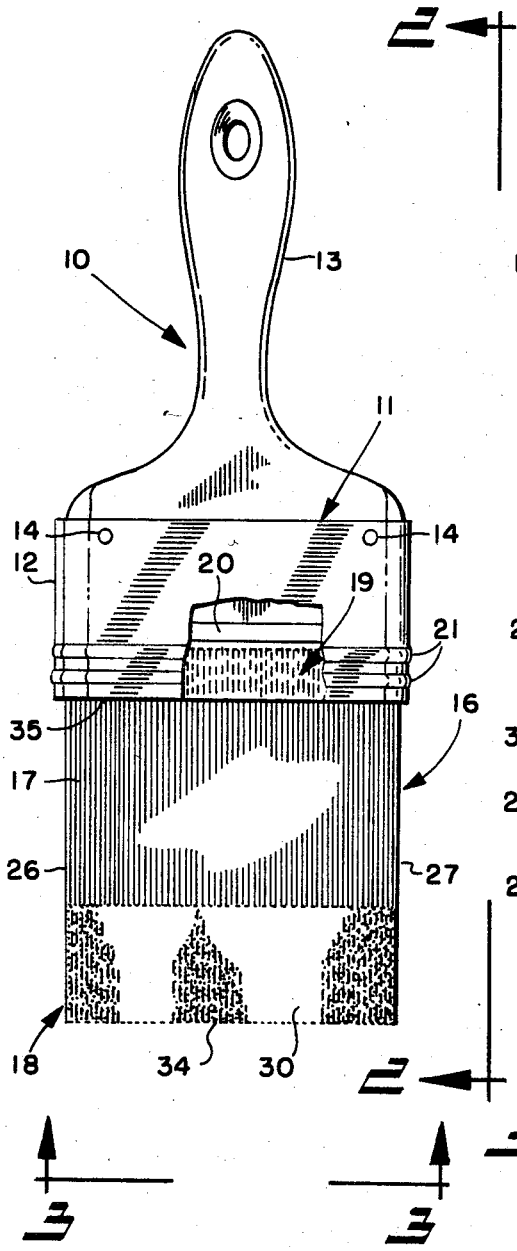
FIG. 1 is a front elevational view of a paint brush according to the invention, partly broken away to show securement of the bristles and handle in the ferrule.
Figure 2:
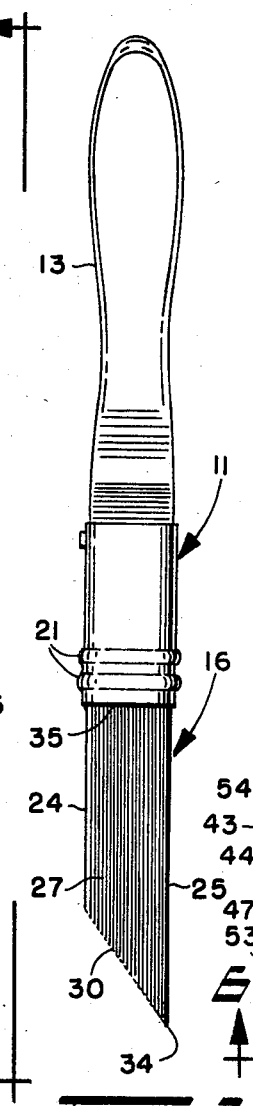
FIG. 2 is a side elevational view of the paint brush of FIG. 1 looking generally in the direction of the arrows 2—2 of FIG. 1.
Figure 3:
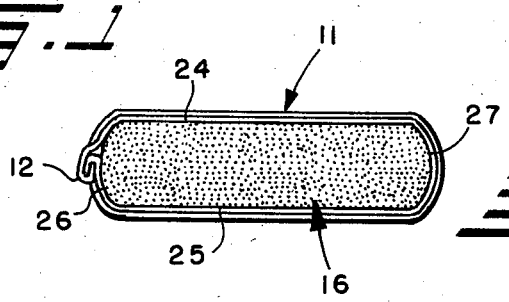
FIG. 3 is a bottom plan view of the brush of FIG. 1 looking generally in the direction of the arrows 3—3 of FIG. 1.

Referring now in detail to the drawings and initially to FIGS. 1-3, a general purpose paint brush according to the invention is indicated generally at 10. The brush 10 includes a tubular member or ferrule 11 which may be formed from sheet metal and connected along one edge as by means of a lap joint 12. An elongate handle 13 longitudinally aligned with the ferrule has a wide end portion received in the ferrule and coupled to the ferrule as by one or more nails 14 as in conventional manner.

The brush 10 also includes a bundle or tuft 16 of bristles individually indicated at 17. The tuft 16 has a working end 18 and a root end 19, the latter being anchored in the ferrule 11 opposite the handle 13. The root ends of the bristles 17 may be bonded together by a suitable hardenable adhesive 20 such as epoxy or the equivalent to form a bristle knot upon hardening of the adhesive. The adhesive cured or hardened in situ in the ferrule not only adheres to the bristles but also to the interior surface of the ferrule for holding the bristle knot in place. The ferrule also may be provided with one or more annular beads 21 into which the adhesive may flow to lock the bristle knot in the ferrule, as is conventional.

The bristles 17, which may be synthetic or natural, extend in generally parallel relationship and generally longitudinally in relation to the ferrule 11 and handle 13. The bristles are relatively closely bundled to form the tuft 16 which is generally rectangular in transverse cross-section as best seen in FIG. 3. The tuft has substantially parallel, longitudinally extending wide side faces 24 and 25 and substantially parallel, longitudinally extending narrow end faces 26 and 27 which may be slightly convex as seen in FIG. 3. The side faces 24 and 25 extend the full width of the tuft which is considerably greater than the thickness of the tuft defined between the side faces 24 and 25.

At its working end 18 for applying paint or other fluid-like material to a surface, the tuft 16 has a planar or substantially planar working surface 30 which extends width-wise between the narrow end faces 26 and 27 and which is sharply angled from the side face 25 of the tuft to the other side face 24 across the full thickness or narrower dimension of the tuft. The angle of the working surface preferably is greater than 45° in relation to a plane normal to the lengths of the bristles 17 with an angle of about 60° being preferred. The angle, however, can be varied for different applications.

The full thickness, angled working surface 30 of the tuft 16 results in greater exposure of bristles 17 at the working surface as compared to a conventional brush of corresponding type and size, i.e., the tuft of each brush having the same overall width, thickness and length. The greater exposure permits the brush 10 to hold and apply more paint as the brush is stroked across a surface with the working surface 30 contacting the surface to be painted. Tests have shown that a brush according to the invention will pick up and apply as much as twice the amount of paint as a conventional paint brush of substantially the same size and type with one stroke of the brush because of the increased exposure of the bristles at such working surface 30. With respect to paint holding capability alone, tests have shown that a brush according to the invention will pick up substantially more paint than a conventional paint brush of substantially the same size such as on the order of about 30% more paint. There also was a substantial increase in the length of a single pass paint stripe made by the brush of the present application on the order of about 14% with an increase in film thickness exceeding 100%.

In addition to improved paint holding and transfer capability of the brush 10, the working surface 30 forms with the longer side face 25 of the tuft a sharp, straight knife edge 34 in the plane of the side face 25 which permits very sharp trimming and which is located such that during painting the painter can easily see the edge being painted. Overall, free hand trimming is greatly facilitated by the sharp edge 34 in combination with more paint flowing off the working surface 30 by reason of the substantial number of exposed filaments at the working surface which is approximately twice the number of operative filaments of a conventional brush of the same size during each stroke of the brush.

It is noted that the tuft end 35 of the ferrule 11 is coplanar and extends at right angles to the lengths of the bristles 17 and parallel to the knife edge 34 across the entire width of the tuft 16 along both side faces 24, 25. Accordingly, the ferrule does not interfere with free flexure of the bristles in the area of working surface 30.

Figure 4:
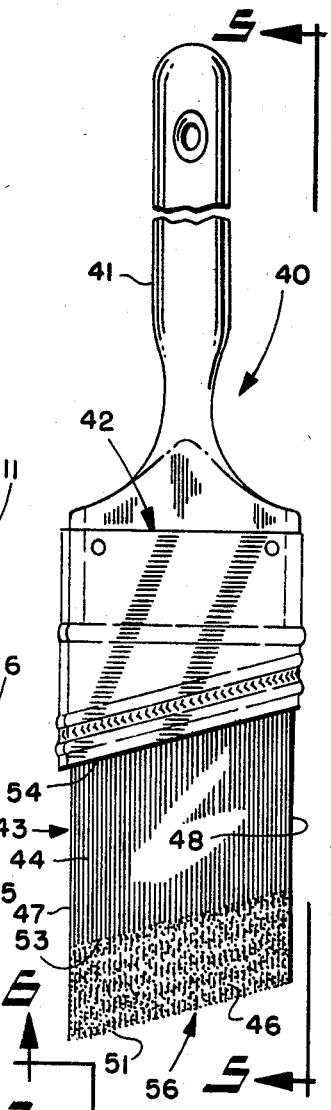
FIG. 4 is a front elevational view of another embodiment of paint brush according to the invention.
Figure 5:
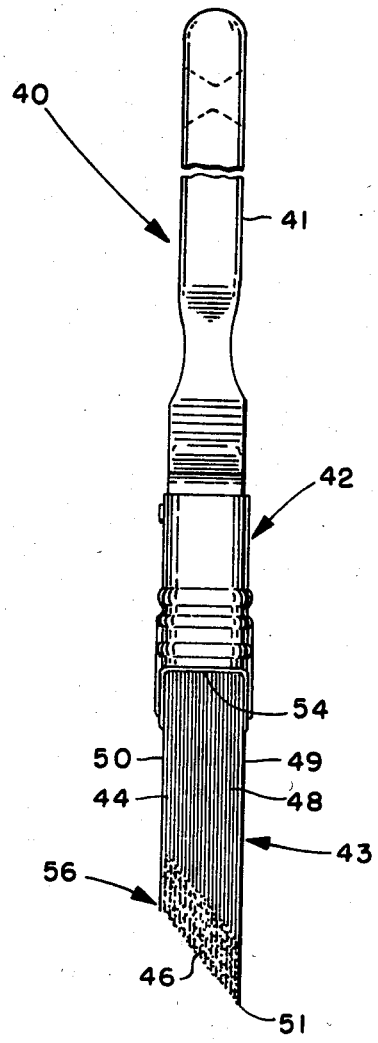
FIG. 5 is a side elevational view of the paint brush of FIG. 4 looking generally in the direction of the arrows 5—5 of FIG. 4.
Figure 6:
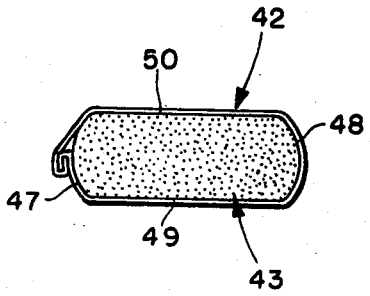
FIG. 6 is a bottom plan view of the brush of FIG. 4 looking generally in the direction of the arrows 6—6 of FIG. 4.

Turning now to FIGS. 4-6, another embodiment of paint brush according to the invention is indicated generally at 40. Except as indicated below, the paint brush 40 is substantially similar in construction to the aforedescribed paint brush 10, including a handle 41, a ferrule 42 and a tuft 43 of bristles 44.

The planar working surface 46 of the tuft 43, as before, extends width-wise between narrow end faces 47 and 48 of the tuft and is sharply angled from a longer wide side face 49 of the tuft to the other shorter wide side face 50 across the full thickness or narrower dimension of the tuft. In addition, the working surface 46 is angled from the narrow end face 47 of the tuft to the other narrow end face 48 across the full width of the tuft to provide an angled knife edge 51 formed at the intersection of the working surface 46 with the longer wide face 49. As seen in FIG. 4, the line 53 formed at the intersection of the working surface 46 and shorter side face 50 is parallel to the knife edge 51 as is the plane of the tuft end 54 of the ferrule 42. The tuft end 54 of the ferrule angles downwardly across the width of the tuft from the shorter narrow end face 48 of the tuft to the longer end face 47.

As will be appreciated, the thusly provided compound angled working end 56 of the tuft 43 provides not only the aforementioned greater exposure of bristles at the working surface 46 but also a sharp, straight and angled knife edge 51 more suited for some trimming applications.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

I claim:

1. A general purpose paint brush comprising an elongate handle, a generally tubular, longitudinally extending ferrule secured to said handle, and a tuft of paint brush bristles having a working end and a root end, said root end being anchored in said ferrule with the bristles extending longitudinally in relation to said ferrule to said working end, said tuft having substantially parallel wide planar side faces extending transversely the width of said tuft and defining therebetween a lesser thickness of said tuft, said handle being longitudinally aligned with said ferrule throughout the entire length of said handle, and said working end of said tuft having substantially planar working surface means extending the full width of said tuft and sharply angled in relation to a plane normal to lengths of the bristles from one side face to the other side face of said tuft across the full thickness of said tuft to provide for greater exposure of bristles at the working surface means to permit the brush to hold and apply more paint, said working surface means forming with the longer of said side faces a sharp knife edge, said ferrule having a tuft end terminating at a plane normal to the longitudinal extents of the bristles and parallel to said knife edge across the entire width of said tuft along both of said side faces.

2. A paint brush as set forth in claim 1, wherein said knife edge extends normal to the length of the bristles in the plane of the longer of said side faces.

3. A general purpose paint brush comprising an elongate handle, a generally tubular, longitudinally extending ferrule secured to said handle, and a tuft of bristles having a working end and a root end, said root end being anchored in said ferrule with the bristles extending longitudinally in relation to said ferrule to said working end, said tuft having substantially parallel wide planar side faces extending transversely the width of said tuft and defining therebetween a lesser thickness of said tuft, and said working end of said tuft having a substantially planar working surface extending the full width of said tuft and sharply angled in relation to a plane normal to lengths of the bristles from one side face to the other side face of said tuft across the full thickness of said tuft to provide for greater exposure of bristles at the working surface to permit the brush to hold and apply more paint, said working surface also being angled in relation to said plane normal to the lengths of the bristles across the full width of said tuft between substantially parallel narrow end faces of said tuft.

4. A paint brush as set forth in claim 3, wherein said working surface forms with the longer of said side faces a sharp knife edge extending width-wise at an angle to said plane normal to the lengths of the bristles and in the plane of the longer of said side faces.

5. A paint brush as set forth in claim 4, wherein said working surface meets the shorter of said side faces at a line parallel to said knife edge.

6. A paint brush as set forth in claim 4, wherein said ferrule has a tuft end terminating at a plane parallel to said knife edge.

7. A paint brush as set forth in claim 1, wherein said tuft has a width to thickness ratio greater than 3:1.

8. A general purpose paint brush comprising an elongate handle, a generally tubular, longitudinally extending ferrule secured to said handle, and a tuft of bristles having a working end and a root end, said root end being anchored in said ferrule with the bristles extending longitudinally in relation to said ferrule to said working end, said tuft having substantially parallel wide planar side faces extending transversely the width of said tuft and defining therebetween a lesser thickness of said tuft, and said working end of said tuft having a substantially planar working surface extending the full width of said tuft and sharply angled in relation to a plane normal to lengths of the bristles from one side face to the other side face of said tuft across the full thickness of said tuft to provide for greater exposure of bristles at the working surface to permit the brush to hold and apply more paint, said working surface forming with the longer of said side faces a sharp knife edge, the angle of said working surface in relation to a plane normal to the lengths of said bristles being greater than 45°.

9. A paint brush as set forth in claim 8, wherein the angle of said working surface in relation to a plane normal to the lengths of said bristles is approximately 60°.

* * * * *